US005646360A

United States Patent [19]

Liao

[11] Patent Number: 5,646,360

[45] Date of Patent: Jul. 8, 1997

[54] COLLAPSIBLE FOOT PEDAL ASSEMBLY OF A MUSICAL INSTRUMENT

[75] Inventor: Tsun-Chi Liao, Tiachung, Taiwan

[73] Assignee: Hwa Shin Musical Instrument Co., Ltd., Taichung, Taiwan

[21] Appl. No.: 660,447

[22] Filed: Jun. 7, 1996

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS 4,873,910 10/1989 Kurosaki ..... 84/422.1

*Primary Examiner*—Michael L. Gellner
*Assistant Examiner*—Shih-yung Hseih
*Attorney, Agent, or Firm*—Bacon & Thomas

[57] ABSTRACT

A pedal assembly for use in for use in a musical instrument, including a base plate, and a pedal unit, the base plate having two upright lugs and two key holes spaced between the upright lugs for mounting the pedal unit, the upright lugs having a respective backward coupling notch, the pedal unit having a mounting frame secured to the key holes of the base plate by tie screws, and two locating elements fixedly mounted at two opposite sides of the mounting frame and detachably coupled to the backward coupling notches of the upright lugs of the base plate, wherein the pedal unit can be turned downwards and collapsed when it is forced backwards to release the locating elements from the backward coupling notches of the upright lugs and the tie screws from the narrower front sections of the key holes.

1 Claim, 9 Drawing Sheets

COLLAPSIBLE FOOT PEDAL ASSEMBLY OF A MUSICAL INSTRUMENT

BACKGROUND OF THE INVENTION

The present invention relates to the foot pedal assembly of a musical instrument for example a bass drum, and relates more particularly to such a foot pedal assembly which can be conveniently collapsed.

The foot pedal assembly of a musical instrument for example a bass drum, as shown in FIGS. 1 and 2, is generally comprised of base plate, and a pedal unit. The pedal unit comprises a mounting frame having two screw holes at the bottom side. The base plate comprises two upright lugs at two opposite sides respectively fastened to two opposite sides of the mounting frame of the pedal unit by a respective fastening clement, and two screw holes spaced between the upright lugs and respectively fastened to the screw holes of the mounting frame of the pedal unit by a respective screw. This structure of foot pedal assembly is stable in use. However, it is heavy and complicated to install. Furthermore, this structure of foot pedal assembly requires much storage space because it is not, collapsible when not in use. If to detach all parts of the foot pedal assembly from one another, the fastening elements must be carefully packed in a bag or the like.

SUMMARY OF THE INVENTION

It is one object of the present invention to provide a foot pedal assembly which is collapsible. It is another object of the present invention to provide a foot pedal assembly which can be conveniently collapsed without dismounting the fastening elements thereof. It is still another object of the present invention to provide a foot pedal assembly which can be conveniently collapsed without the use of any tools. To achieve these and other objects of the present invention, the base plate is made having two upright lugs at two opposite sides and two key holes spaced between the upright lugs for mounting the pedal unit. The upright lugs have a respective backward coupling notch. The pedal unit comprises a mounting frame secured to the key holes of the base plait by tie screws, and two locating elements fixedly mounted at two opposite sides of the mounting frame and detachably coupled to the backward coupling notches of the upright lugs of the base plate. The pedal unit can be turned downwards and collapsed when it is forced backwards to release the locating elements from the backward coupling notches of the upright lugs and to move the tie screws from the, narrower front sections of the key holes to the broader rear sections thereof.

DETAILED DESCRIPTION OF THE PREFERRED EMBODIMENT

Figure 1:
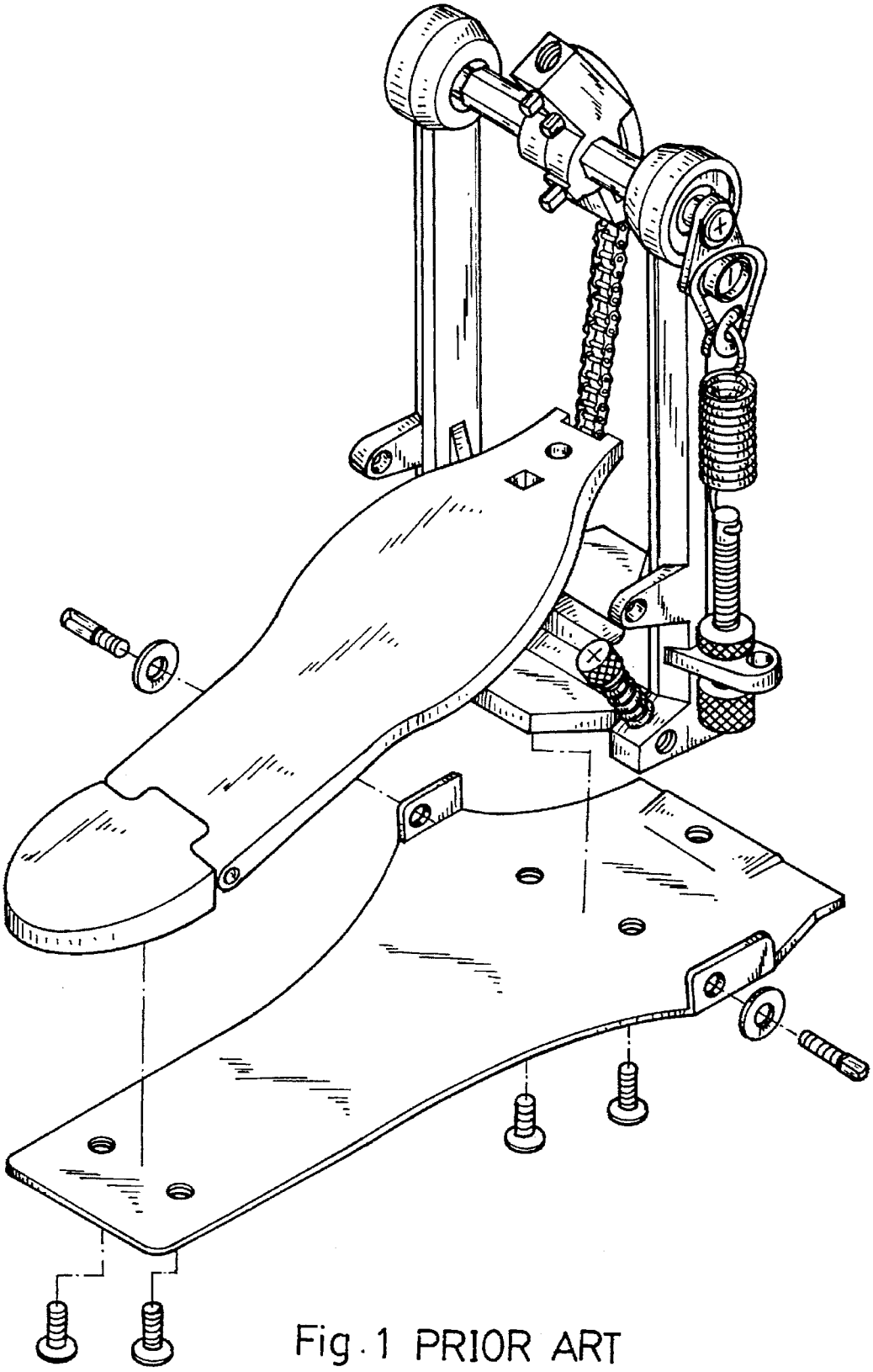
Fig. 1 PRIOR ART
FIG. 1 is an exploded view of a foot pedal assembly for use in a musical instrument according to the prior art.
Figure 2:
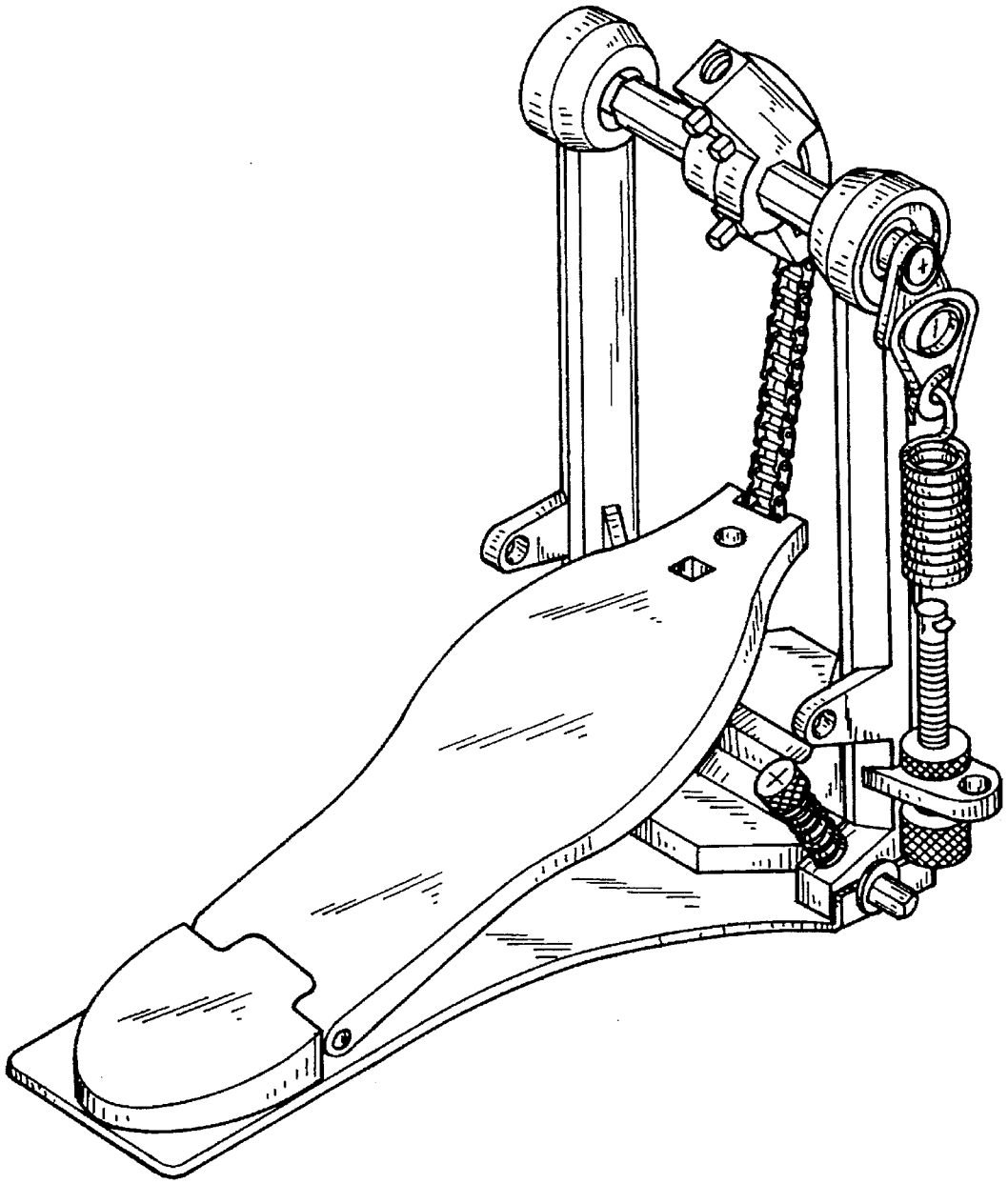
Fig. 2 PRIOR ART
FIG. 2 is an elevational view of the foot pedal assembly show in FIG. 1.
Figure 3:
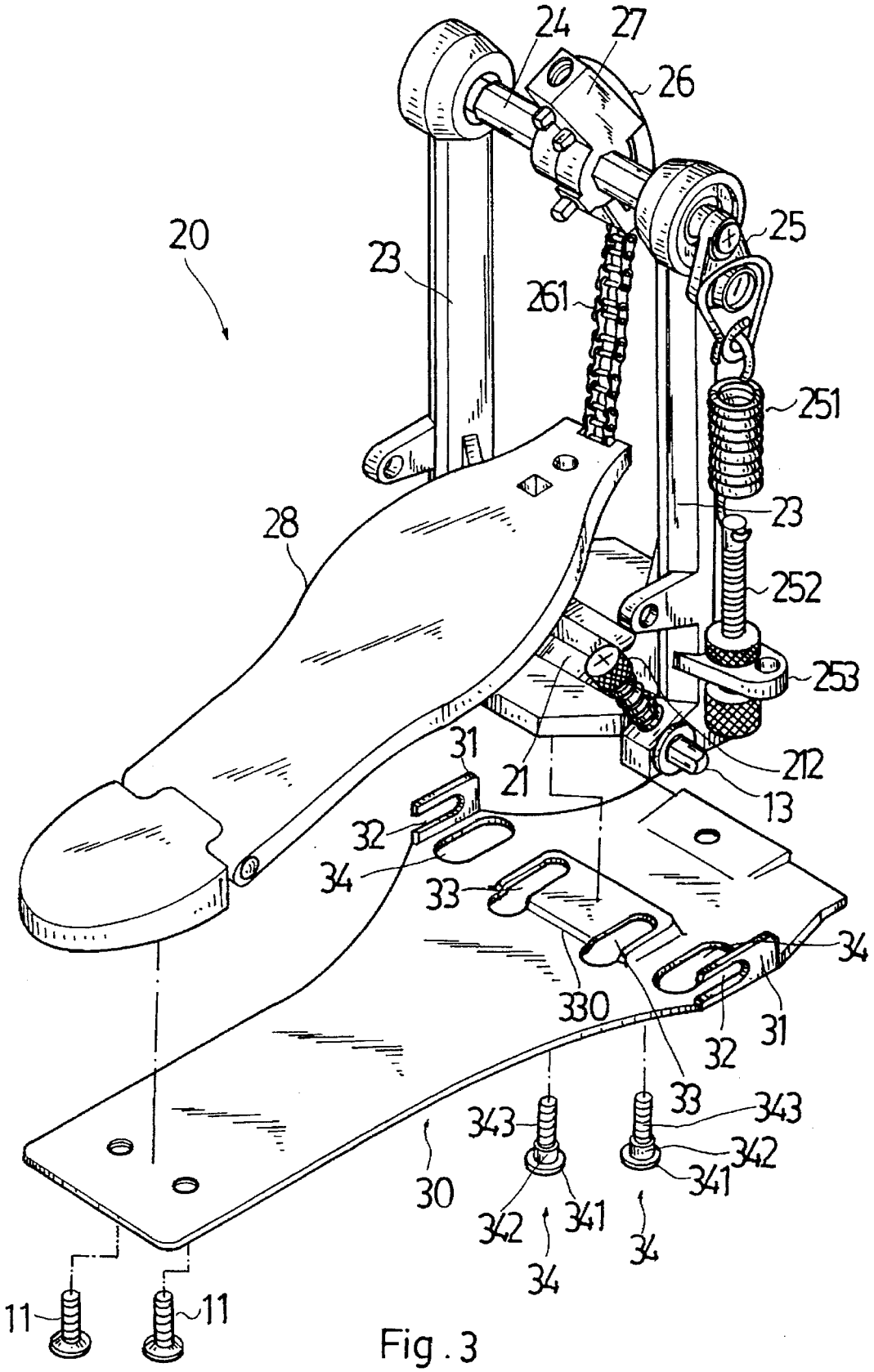
FIG. 3 is an exploded view of a foot pedal assembly for use in a musical instrument according to the present invention.
Figure 4:
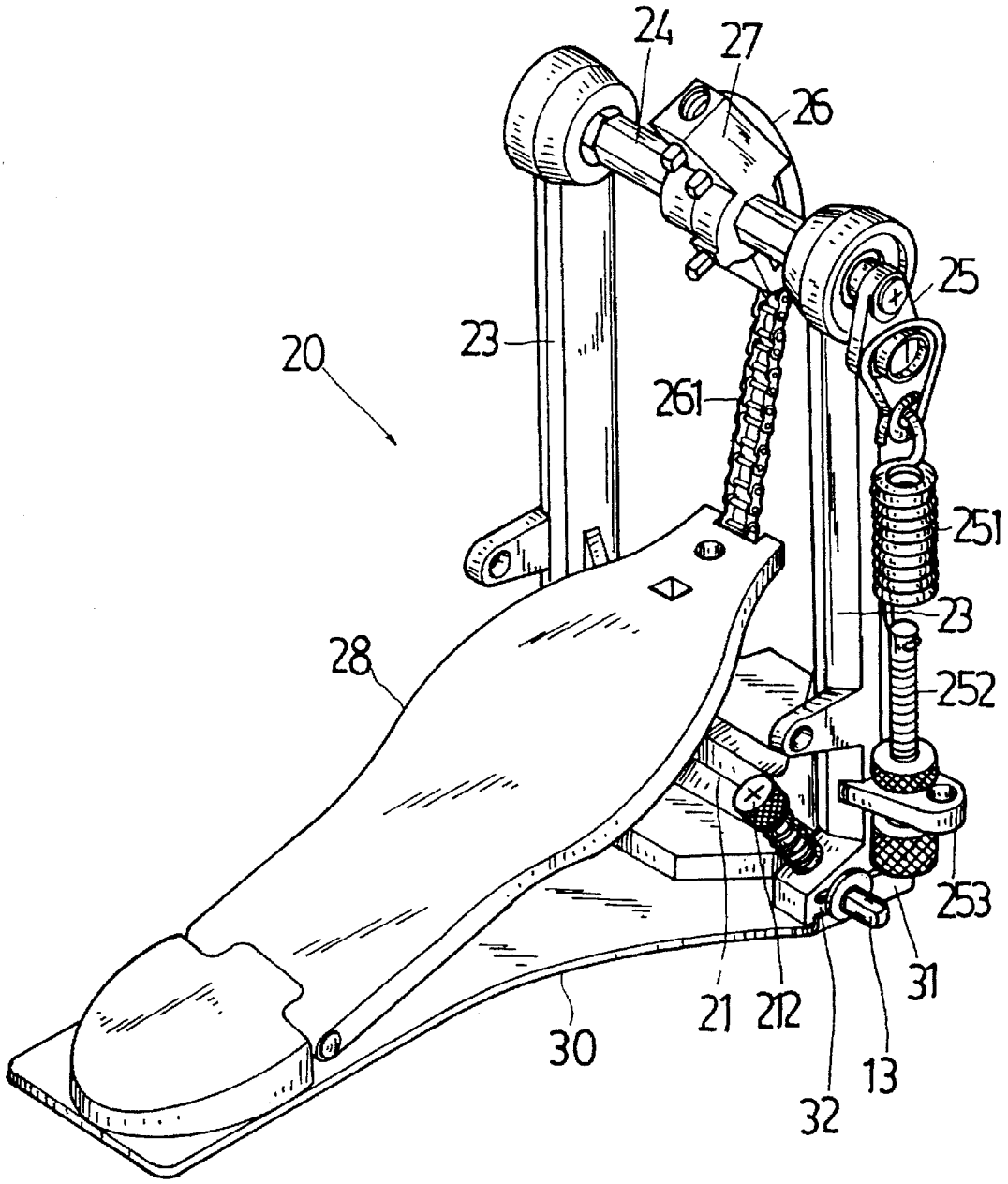
FIG. 4 is an elevational view of the foot pedal assembly shown in FIG. 3.

Referring to FIGS. 3 and 4, a foot assembly in accordance with the present invention is generally comprised of a pedal unit 20, and a base plate 30. The pedal unit 20 comprises a frame 21 having two spring-supported screws 212 obliquely disposed at two opposite sides and two screw holes (not shown) at the bottom side, two upright supports 23 bilaterally raised from the mounting frame 21, a revolving shaft 24 transversely supported between the upright supports 23, a lug 253 outwardly raised from one upright support 23 near the mounting frame 21, a locating bolt 252 fastened to the lug 253, a block 25 fixed to one end of the revolving shaft 24, a spring 251 having a top end connected to the block 25 and a bottom end connected to the locating bolt 252, a fly wheel 26 and a beater holder 27 respectively mounted on the revolving shaft 24 in the middle, a pedal 28, a chain 261 having a top end connected to the fly wheel 26 and bottom end connected to the front end of the pedal 28, and two outward locating elements 13 at two opposite sides of the mounting frame 21. The pedal 28 is comprised of two parts hinged together. The rear end of the pedal 28 is fixedly fastened to the rear end of the base plate 30 by screws 11. The aforesaid pedal unit 20 is a known structure not within the scope of the present invention, therefore it is not described further.

Figure 5:
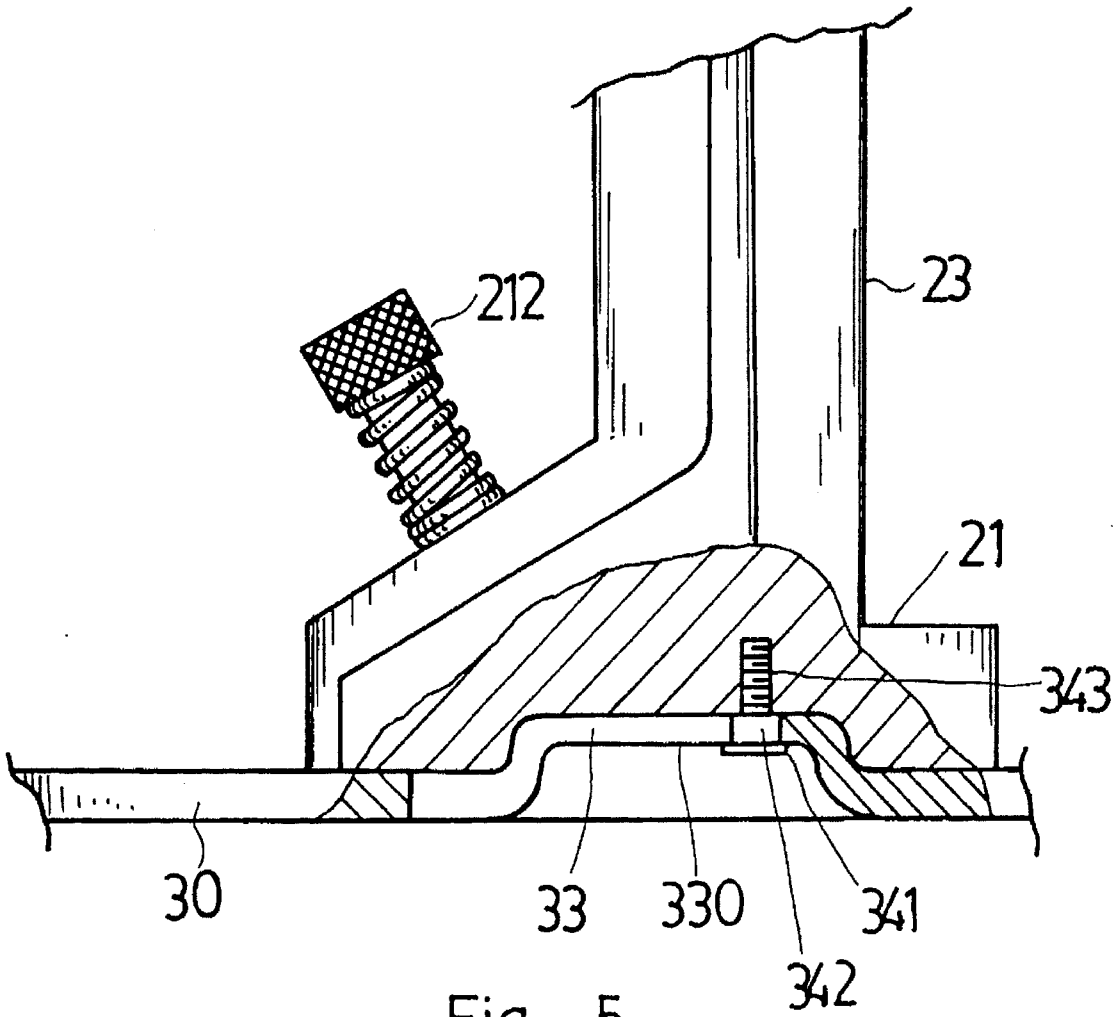
FIG. 5 is a sectional view in an enlarged scale of a part of the present invention, showing the tie screw mounted in the key hole and threaded into the screw hole in the mounting frame.

Referring to FIG. 5, and FIGS. 3 and 4 again, the base plate 30 comprises two upright lugs 31 at two opposite sides corresponding to the upright support 23 of the pedal unit 20 and defining a respective backward coupling notch 32 adapted for coupling to the locating elements 13 of the pedal unit 20, a raised surface portion 330 the top between the upright lugs 31, two key holes 33 partially cut through the raised surface portion 330 and respectively connected to the screw holes of the mounting frame 21 of the pedal unit 20 by a respective tie screw 34 (each of the key holes 33 has a narrower front section and a broader rear section), two slots 34 respectively spaced between the upright lugs 31 and the key holes 33 for the insertion of the spring-supported screws 212 of the pedal unit 20. Each of the tie screws 34 comprises a screw head 341 stopped at the bottom side of the base plate 30, a screw body 343 threaded into one screw hole of the mounting frame 21 of the pedal unit 20, and a collar 342 connected between the head 341 and the screw body 343 and forced into engagement with the narrower front section of one key hole 33 (see FIG. 5). During the assembly process, the locating elements 13 of the pedal unit 20 are respectively forced into the backward coupling notch 32, then the tie screws 34 are respectively inserted through the broader rear sect ions of the key holes 33 and then threaded into the respective screw holes of the mounting frame 21 of the pedal unit 20, and then the mounting frame 21 is forced forwards relative to the base plate 30 to force the locating elements 13 into engage, merit with the backward coupling notches 32 of the upright lugs 31 and the collars 342 of the tie screws 34 into engagement with the narrower front sections of the key holes 33.

Figure 6A:
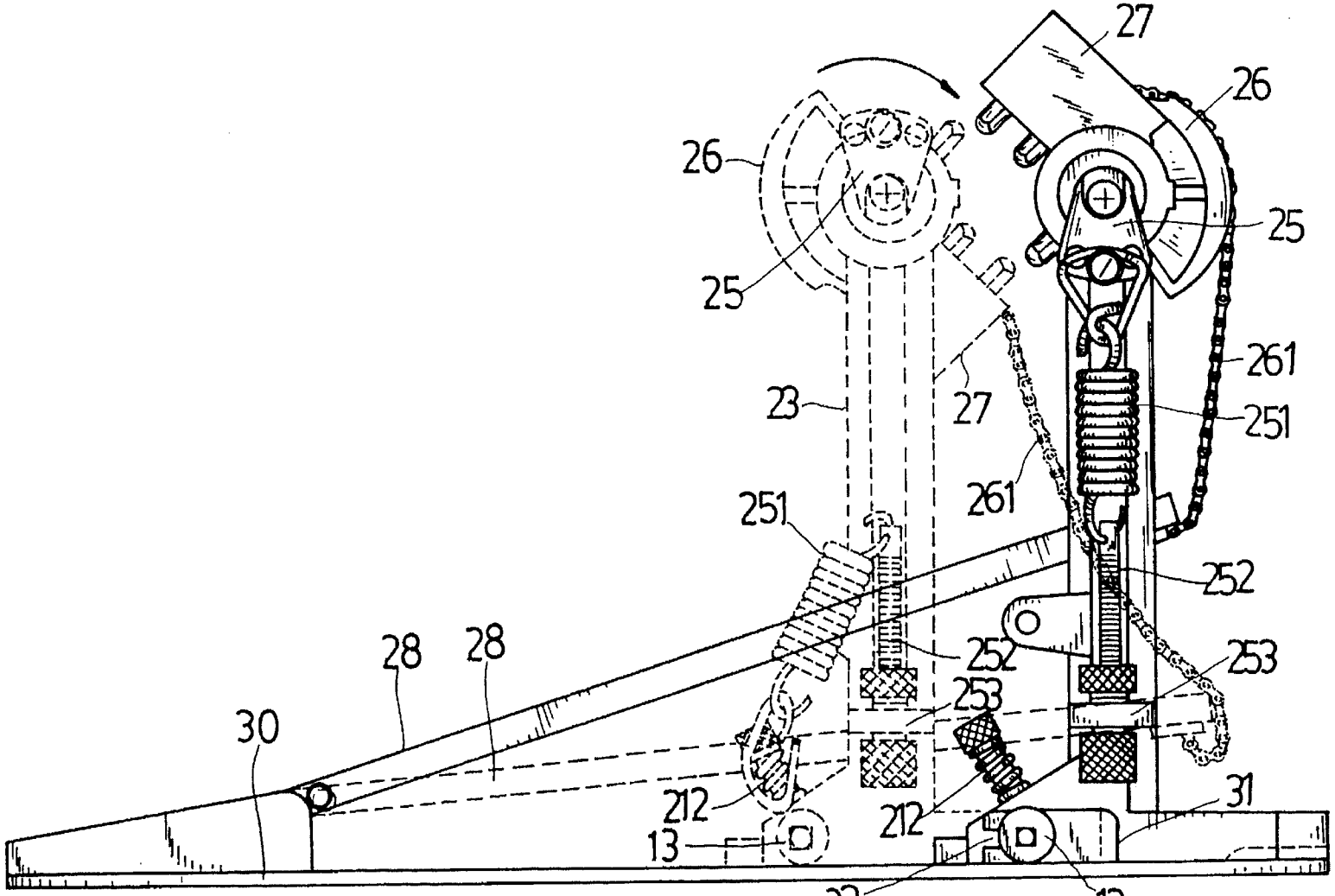
FIG. 6A shows the upright supports and mounting frame of the pedal unit forward backwards relative to the base plate, and the coupling elements disengaged from the backward coupling notches of the upright lugs.
Figure 6B:
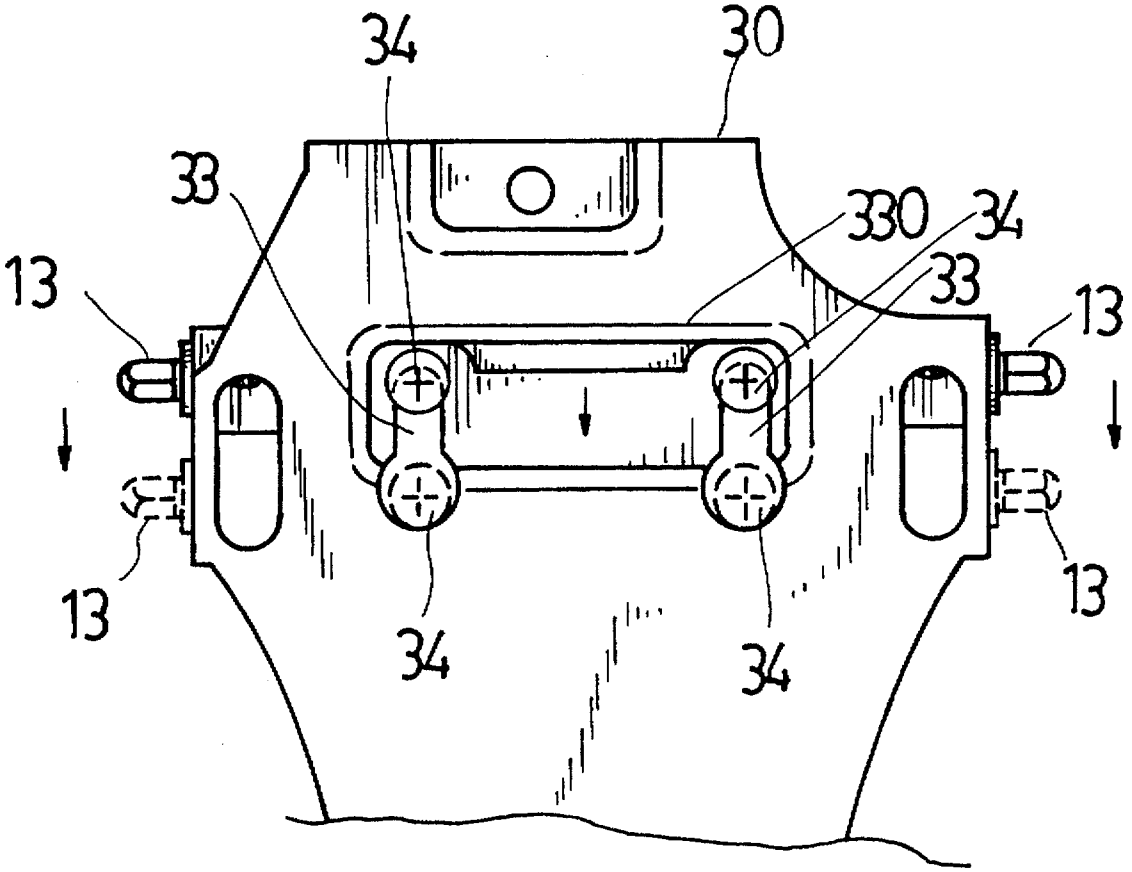
FIG. 6B is a bottom view of a part of FIG. 6A, showing the tie screws moved from the narrower front sections of the key holes to the broader rear sections thereof.

Referring to FIGS. 6A and 6B, when the upright supports 23 of the pedal unit 20 are moved backwards relative to the base plate 30, the locating elements 13 are disengaged from the backward coupling notches 32 of the upright lugs 31 and the collars 342 of the tie screws 34 are disengaged from the narrower front sections of the key holes 33. When the locating elements 13 are disengaged from the backward coupling notches 32 and the collars 342 of the tie screws 34 are disengaged from the narrower front sections of the key holes 33, the spring 251 is disconnected from the block 25. When the spring 251 is disconnected from the block 25, the fly wheel 26 and the revolving shaft 24 are released from the constraint of the spring 251, permitting the pedal assembly to be collapsed.

Figure 7:
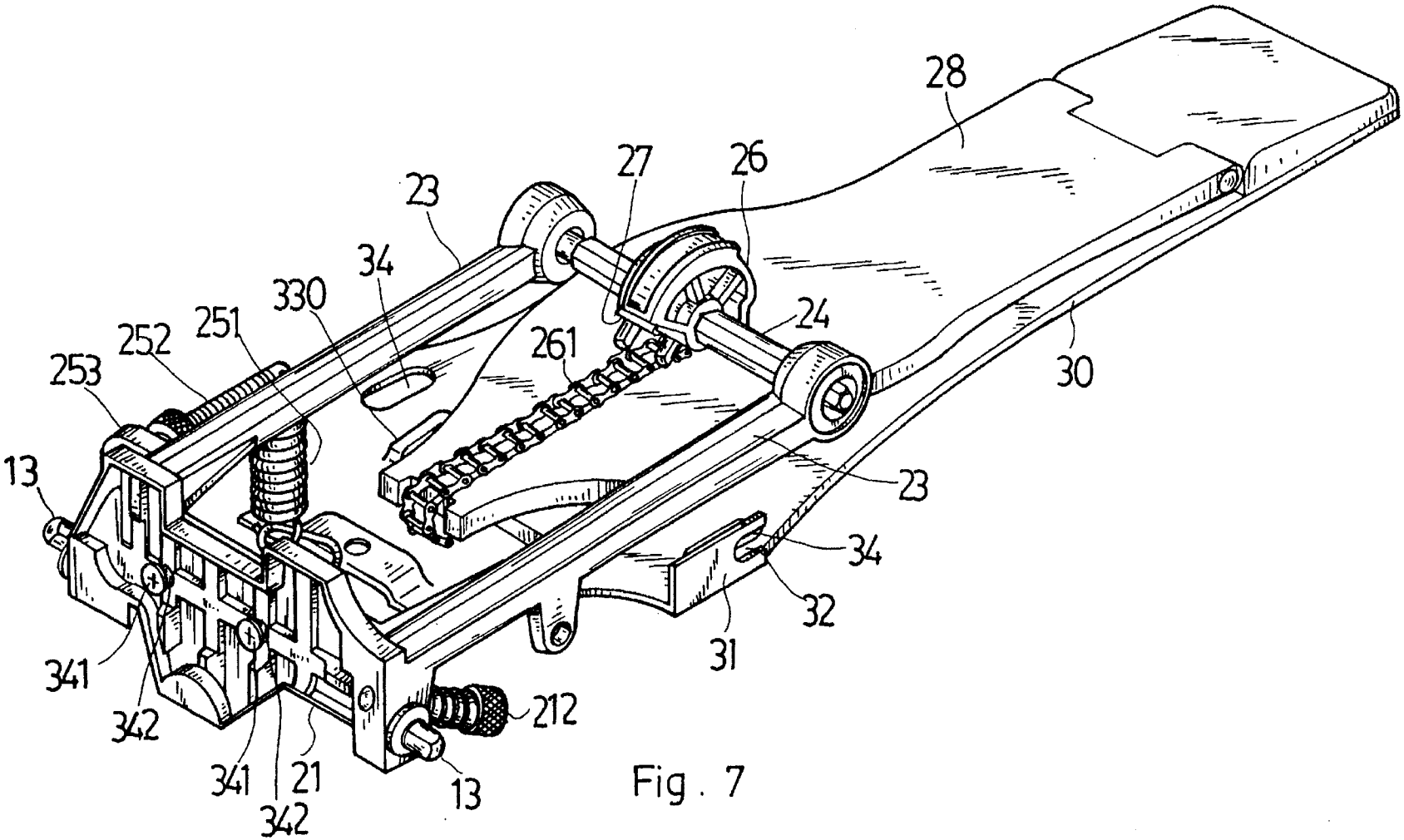
FIG. 7 shows the pedal assembly of the present invention collapsed (Example I)
Figure 8:
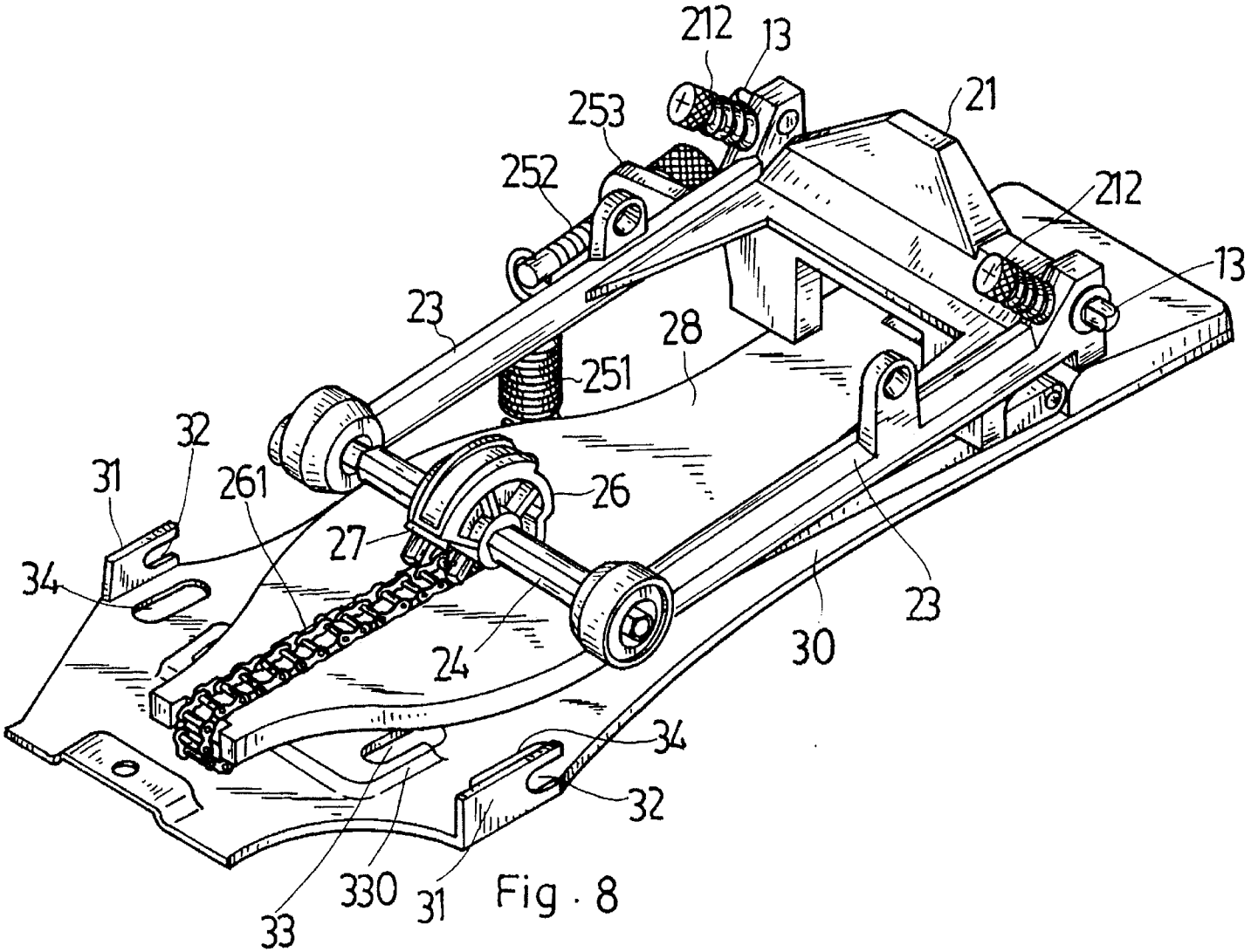
FIG. 8 shows the pedal assembly of the present invention collapsed (Example II).

FIG. 7 shows the pedal unit 20 turned downwards and collapsed. When the pedal assembly is collapsed, the revolving shaft, 24, the fly wheel 26, and the beater holder 27 are closely attached to the top of the pedal 28, and the frame 21 protrudes over the front end of the pedal 28. The pedal unit 20 may be turned through about 270× and then collapsed, permitting the mounting frame 21 be closely attached to the pedal 28 (see FIG. 8).

I claim:

1. A pedal assembly of the type comprising a pedal unit and a base plate, said base plate comprising two upright lugs bilaterally disposed near a front end thereof, said pedal unit comprising a mounting frame having two bottom screw holes, two upright supports raised from said mounting frame to hold a revolving shaft, a fly wheel and a beater holder mounted on said revolving shaft, a pedal coupled to said fly wheel by a chain, two locating elements fixedly fastened to two opposite sides of said mounting frame and respectively secured to the upright lugs of said base plate, wherein said base plate comprises a raised surface portion at a top side thereof between said upright lugs, two key holes partially cut through said raised surface portion and respectively connected to the bottom screw holes of said mounting frame of said pedal unit by a respective tie screw, and two tie screws respectively mounted in said key holes and threaded into the bottom screw holes of said mounting frame of said pedal unit, each of said key holes comprising a narrower front section and a broader rear section, each of said tie screws comprising a head stopped outside said key holes and having a smaller diameter than the width of the broader rear section of each of said key holes, a screw body inserted through the narrower front section of one key hole and threaded into one bottom screw hole of said mounting frame, and a collar connected between said screw head and said screw body and inserted through the broader rear section of the corresponding key hole and then forced into engagement with the narrower front section of the respective key hole, each of the upright lugs of said base plate having a backward coupling notch adapted for coupling to the locating elements of said pedal unit.

* * * * *